United States Patent [19]

Uga

[11] 4,308,608

[45] Dec. 29, 1981

[54] DIGITAL ELECTRONIC TIMEPIECES

[75] Inventor: Kozo Uga, Kawasaki, Japan

[73] Assignees: Toyota Jidosha Kogyo Kabushiki Kaisha, Toyota; Nippondenso Co., Ltd., Kaliya; Jeco Co., Ltd., Kawasaki, all of Japan

[21] Appl. No.: 173,669

[22] Filed: Jul. 29, 1980

[30] Foreign Application Priority Data

Jul. 31, 1979 [JP] Japan ..... 54-104814[U]

[51] Int. Cl.[3] ..... G04B 19/24

[52] U.S. Cl. ..... 368/29; 368/30; 368/69; 368/70; 368/71

[58] Field of Search ..... 368/29, 30, 69, 70, 368/71, 187, 188, 189

[56] References Cited

U.S. PATENT DOCUMENTS

| | | | |
|---|---|---|---|
| 3,668,859 | 6/1972 | Polin et al. | 368/187 |
| 3,810,356 | 5/1974 | Fujita | 368/69 |
| 3,852,950 | 12/1974 | Yoda et al. | 368/29 |
| 3,855,780 | 12/1974 | Kashio | 368/29 |
| 3,943,696 | 3/1976 | Portmann et al. | 368/29 |
| 4,107,915 | 8/1978 | Sekiya et al. | 368/72 X |
| 4,170,870 | 10/1979 | Burdet | 368/71 |

*Primary Examiner*—Ulysses Weldon

*Attorney, Agent, or Firm*—Charles E. Pfund

[57] ABSTRACT

In a digital electronic timepiece in which days of the week, hours and minutes are displayed on a display device and the displayed days of the week, hours and minutes can be corrected with a correction switch, a time correction switch is used to also correct a displayed day of the week.

5 Claims, 3 Drawing Figures

DIGITAL ELECTRONIC TIMEPIECES

BACKGROUND OF THE INVENTION

This invention relates to a digital electronic timepiece capable of switching between the day of the week display and the minute-hour display, and more particularly to a digital electronic timepiece capable of correcting the day of the week display by operating a time correction switch while displaying a day of the week.

An ordinary digital electronic timepiece is provided with various transfer switches for switching and correcting displayed contents, and provision of both the switching and correcting functions to one of these transfer switches is advantageous from the standpoint of improving the operation of the transfer switch.

SUMMARY OF THE INVENTION

It is therefore an object of this invention to provide a novel digital electronic timepiece capable of correcting the contents of the day of the week display by operating a time correction switch while displaying a day of the week, without using a switch exclusively used for correcting the day of the week.

Another object of this invention is to provide a novel digital electronic timepiece capable of preventing erroneous correction during display of other modes.

According to this invention, there is provided an electronic timepiece of the type comprising transfer switch means for effecting switching between the day of the week display and the minute-hour display, wherein there are provided time correction switch means, means for preparing a day of the week changing signal by the operation of the time correction switch means while the transfer switch means is for displaying the day of the week, and a day of the week counter connected to receive the day of the week changing signal for correcting the day of the week displayed.

The transfer switch means may be mechanical switches or combinations of gate circuits.

DESCRIPTION OF THE PREFERRED EMBODIMENTS

Figure 1:
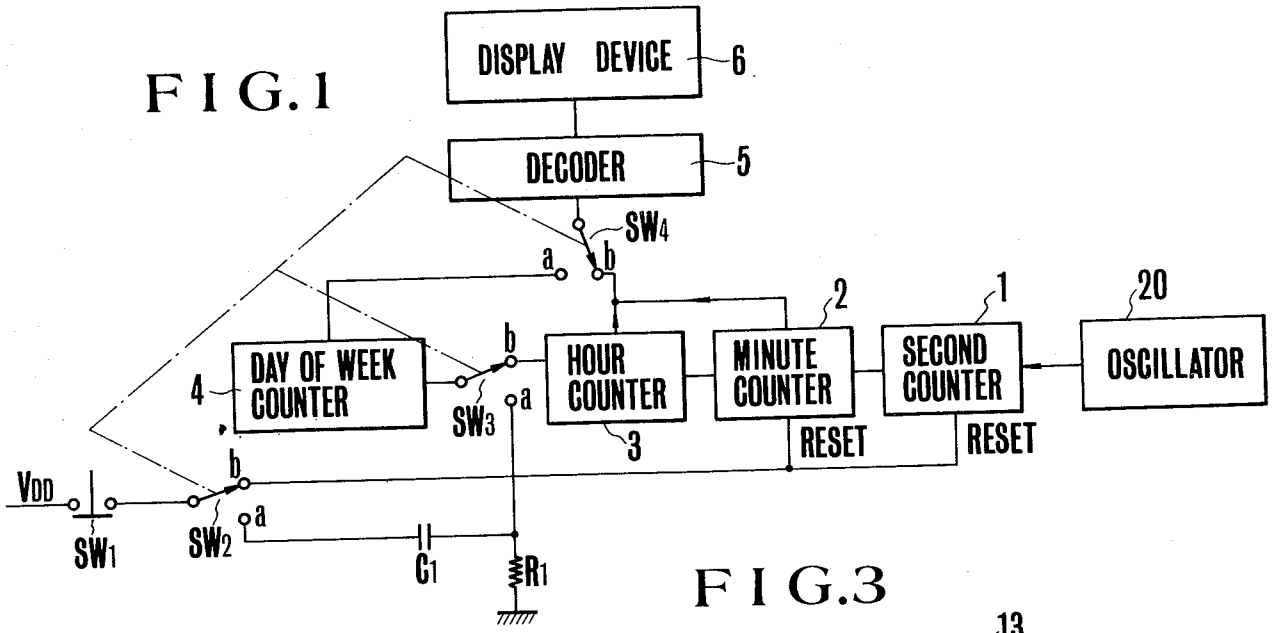
FIG. 1 is a block diagram showing important elements of one embodiment of a digital electronic timepiece according to this invention.

A preferred embodiment of this invention shown in FIG. 1 comprises a second counter 1, a minute counter 2, an hour counter 3, a day of the week counter 4, a decoder 5, a display device 6, a time correction switch $SW_1$, interlocked transfer switches $SW_2$ to $SW_4$ for effecting switching between the day of the week display and minute-hour display, and a capacitor $C_1$ and a resistor $R_1$ which are connected as will be described later. The capacitor $C_1$ and the resistor $R_1$ constitute a differentiating circuit. One end of the time correction switch $SW_1$ is connected to a terminal $V_{DD}$ while the other end is connected to the movable contact of the transfer switch $SW_2$. One stationary contact a of the transfer switch $SW_2$ is connected to one terminal of the capacitor $C_1$ while the other stationary contact b is connected to the rest terminals of the second and minute counters 1 and 2. The movable contact of a transfer switch $SW_3$ is connected to the input terminal of the day of week counter 4, one stationary contact a is connected to the junction between capacitor $C_1$ and resistor $R_1$, and the other stationary contact b is connected to the output terminal of the hour counter 3. The movable contact of the transfer switch $SW_4$ is connected to the input terminal of the decoder 5, one stationary contact a is connected to the output terminal of the day of week counter 4 and the other stationary contact b is connected to the output terminals of the hour and minute counters 3 and 2. One terminal of the resistor $R_1$ is grounded.

In operation, during normal display of time, transfer switches $SW_2$ to $SW_4$ are thrown to their stationary contacts b. Then, the second counter 1 counts the number of timing signals supplied from an oscillator 20 and the output of the counter 1 is successively sent to the minute and hour counters 2 and 3. Thus, the outputs of the minute and hour counters 2 and 3 are applied respectively to the contact b of the transfer switch $SW_4$ and then supplied to the display device 6 via decoder 5 so that the display device 6 displays the counts (hours and minutes) of the counters 3 and 2. When the time correction switch $SW_1$ is closed for a short time, voltage $V_{DD}$ is applied, as a reset signal, to the reset terminals of the second and minute counters 1 and 2 via the time correction switch $SW_1$ and the contact b of the transfer switch $SW_2$ so that the second and minute counters 1 and 2 are simultaneously reset, thereby enabling time correction. When the count of the second counter is 0(zero) to 29 seconds immediately prior to the closure of the time correction switch $SW_1$, the second counter 1 will be reset and no carry is made. On the other hand, when the count of the second counter 1 is 30 to 59 seconds, the second counter 1 sends a carry signal to the minute counter 2 at the same time when it is reset, whereby the count of the second counter 2 is increased by one. As described above, errors of less than 30 seconds can be instantly corrected by the operation of the time correction switch $SW_1$.

When transfer switches $SW_2$ to $SW_4$ are thrown to their stationary contacts a, the output of the day of the week counter 4 is applied to the display device 6 via the contact a of the transfer switch $SW_4$ and the decoder 5 to display a day of the week on the display device 6. During this day of the week display, when the time correction switch $SW_1$ is closed, the voltage $V_{DD}$ is applied to the differentiating circuit comprising capacitor $C_1$ and resistor $R_1$. Then the output of this differentiating circuit is applied to the day of the week counter 4 via the stationary contact a of the display transfer switch $SW_3$ to correct the content of the day of the week is counter 4. More particularly, while a day of the week being displayed, the position of displaying the day of the week is shifted one after one each time the time correction switch $SW_1$ is closed.

According to the embodiment described above, as it is possible to correct the day of the week by changing the mode of operation with a single time correction switch $SW_1$, this switch is also used to correct the day of the week. For this reason, it is not necessary to use independent day of week correction switch and time correction switch. Thus, only one switch is sufficient. Moreover, there is no erroneous correction during other modes of time correction, thus improving the reliability of the operation. Further, as one of the switches is eliminated, the cost of manufacturing can be reduced.

Figure 2:
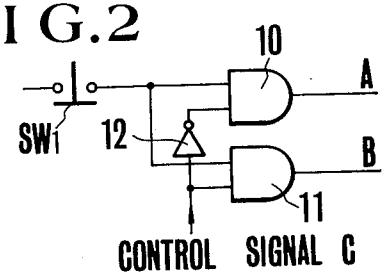
FIGS. 2 and 3 show modified switch circuits that can be used instead of the transfer switch shown in FIG. 1.

FIG. 2 shows one example of a switch circuit that can be substituted for the transfer switch $SW_2$. This switch circuit comprises a pair of AND gate circuits 10 and 11 and an inverter 12. One input terminal of each AND gate circuits 10 and 11 is connected to the time correction switch $SW_1$. The output lines A and B of the AND gate circuits are connected to correspond to the stationary contacts a and b of the transfer switch $SW_2$ so that a transfer operation can be made in response to a control signal C. Namely, with closure of the switch $SW_1$, the voltage $V_{DD}$ is passed through the AND gate circuit 10 when the control signal is at a low level whereas the voltage $V_{DD}$ is passed through the AND gate circuit 11 when the control signal is at a high level.

Figure 3:
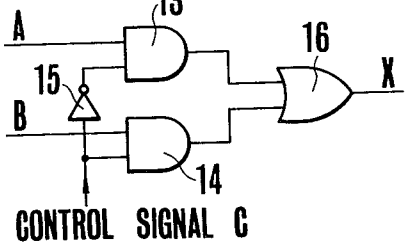

FIG. 3 shows one example of a switch circuit that can be substituted for the individual transfer switches $Sw_3$ and $SW_4$ shown in FIG. 1. This switch circuit comprises two AND gate circuits 13 and 14, an inverter 15, and an OR gate circuit 16. The respective input lines A and B of the AND gate circuits are conncected to correspond to the stationary contacts a and b of the transfer switches $SW_3$ or $SW_4$. With this connection, when the control signal C is at a high level the output X of the OR gate circuit 16 becomes equal to B whereas when the control signal C is at a low level, the output X becomes equal to A.

The signal line for the control signal C shown in FIGS. 2 and 3 is connected to a manually-operated day of week display switch (not shown). When this switch is turned on, the voltage $V_{DD}$ is grounded therethrough to produce the control signal C of low level; and when turned off, the control signal C of high level is produced.

As described above, according to the digital electronic timepiece embodying the invention, as it is possible to correct a displayed day of the week by the operation of a time correction switch, the time correction switch can be used also as a day of the week correction switch.

Accordingly, it is possible not only to decrease the number of switches but also to prevent erroneous correction during the display of other modes.

What is claimed is:

1. An electronic timepiece comprising a second counter, a minute counter, an hour counter which are connected in cascade, a time correction switch connected to receive a timing signal, a first transfer switch connected to apply said timing signal to said second counter and said minute counter, a day of the week counter, a differentiating circuit connected between said first transfer switch and ground, a second transfer switch for selectively connecting an input terminal of said day of the week counter between an output terminal of said hour counter and said differentiating circuit, a display device, and a third transfer switch for selectively connecting said display device between an output terminal of said day of the week counter and output terminals of said minute and hour counters.

2. The electronic digital timepiece according to claim 2 which further comprises a decoder interposed between said display device and said third transfer switch.

3. The electronic digital timepiece according to claim 2 wherein said first, second and third transfer switches are interlocked with each other.

4. The electronic digital timepiece according to claim 2 wherein said first transfer switch comprises a pair of AND gate circuits with one input terminal of each connected to receive said timing signal and the other input terminal of each AND gate connected to receive respectively a control signal and its inverse provided by an inverter connected between the other input terminals of said AND gate circuits.

5. The electronic digital timepiece according to claim 2 wherein each of said second and third transfer switches comprises a pair of AND gate circuits with one input terminal of each connected to receive respectively a control signal and its inverse provided by an inverter connected between said input terminals, and an OR gate circuit with its input terminals connected to respective output terminals of said AND gate circuits.

* * * * *